US006217396B1

(12) United States Patent
Hwang et al.

(10) Patent No.: US 6,217,396 B1
(45) Date of Patent: Apr. 17, 2001

(54) ELECTRICAL CONNECTOR WITH U-SHAPED SPRING CONTACTS

(75) Inventors: Jeng-Yih Hwang; Eric Juntwait, both of Irvine; Gene Whetstone, Corona, all of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/348,714

(22) Filed: Jul. 6, 1999

(51) Int. Cl.[7] ..... H01R 4/48
(52) U.S. Cl. ..... 439/862; 439/874
(58) Field of Search ..... 439/284, 295, 439/660, 862, 626, 874

(56) References Cited

U.S. PATENT DOCUMENTS 2,496,732 * 2/1950 Lyman ..... 439/289
3,157,448 * 11/1964 Crimmins et al. .

FOREIGN PATENT DOCUMENTS 57-56476 * 12/1982 (JP) .

* cited by examiner

*Primary Examiner*—Neil Abrams
(74) *Attorney, Agent, or Firm*—Wei Te Chung

(57) ABSTRACT

An electrical connector includes an insulative housing defining a plurality of spaced channels for receiving and retaining conductive spring contacts therein. Each contact is U-shaped and has an anchoring section fixed in the corresponding channel and an engaging section resiliently attached to the anchoring section by a U-shaped bent section and partially extending beyond the housing for engaging with an electronic device. An opening is defined in the bent section through which a wire extends with a conductive core of the wire being fixed to the anchoring section whereby the engaging section overlaps the wire for reducing the space occupied thereby. The engaging section has a free end having side projections received and retained in recesses defined in side walls of the corresponding channels for preloading the engaging section.

10 Claims, 3 Drawing Sheets

ELECTRICAL CONNECTOR WITH U-SHAPED SPRING CONTACTS

BACKGROUND OF THE INVENTION

1. Field of the Invention

The present invention generally relates to an electrical connector, and in particular to a wire harness connector having a small size.

2. The Prior Art

An electrical connector for connecting individual wires to an electronic device is well known in the electronics field. A wire harness connector has an insulative housing for retaining a number of spring contacts therein. Individual wires are connected to the contacts by soldering or crimping. The contacts of the conventional wire harness connector have a wire securing section extending from an engaging section in a longitudinal direction. Such an arrangement occupies a large amount of space. Thus, the conventional connector has a bulky size which hinders the miniaturization of electronic devices.

It is thus desired to provide a wire harness connector having a small size.

SUMMARY OF THE INVENTION

Accordingly, an object of the present invention is to provide a wire harness connector having a small size.

Another object of the present invention is to provide a wire harness connector having preloaded spring contacts for ensuring proper electrical engagement with an electronic device.

To achieve the above objects, an electrical connector in accordance with the present invention comprises an insulative housing defining a plurality of spaced channels for receiving and retaining conductive spring contacts therein. Each contact is U-shaped and comprises an anchoring section fixed in the corresponding channel and an engaging section resiliently attached to the anchoring section by a U-shaped bent section and partially extending beyond the housing for engaging with an electronic device. An opening is defined in the bent section through which a wire extends with a conductive core of the wire being fixed to the anchoring section whereby the engaging section overlaps the wire for reducing the space occupied thereby. The engaging section has a free end having side projections received and retained in recesses defined in side walls of the corresponding channels for preloading the engaging section.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
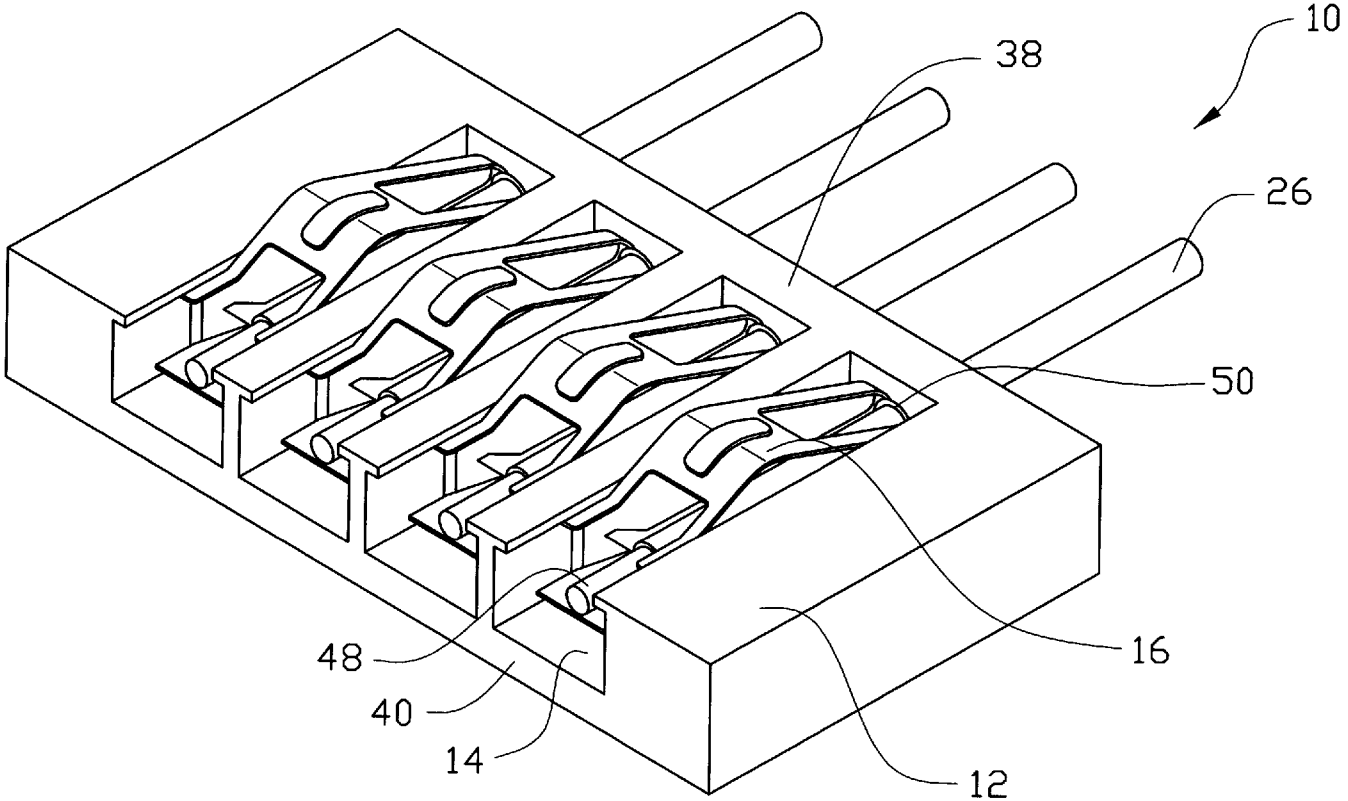
FIG. 1 is a perspective view of an electrical connector constructed in accordance with the present invention.
Figure 2:
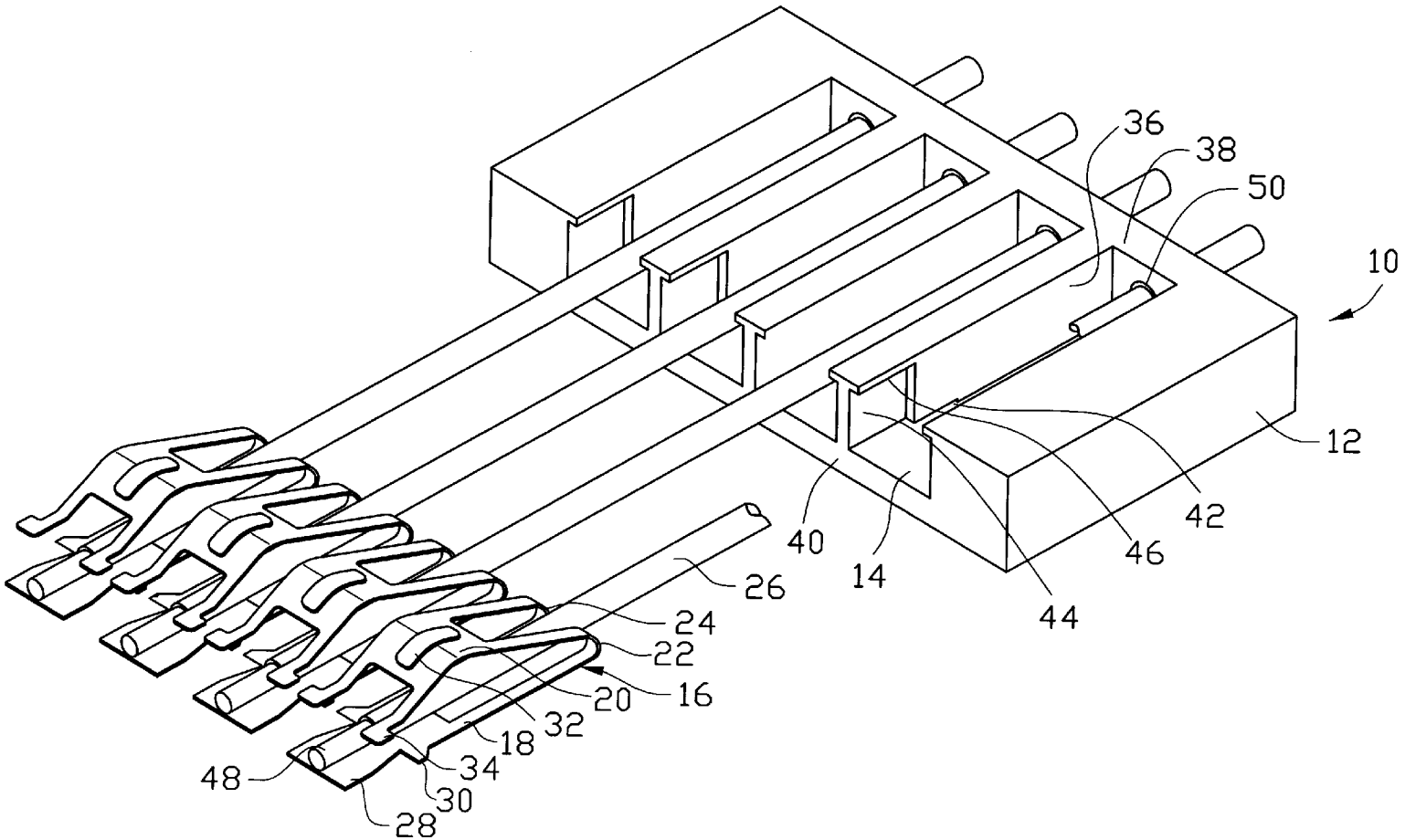
FIG. 2 is an exploded view of the electrical connector of the present invention.

Referring to the drawings and in particular to FIGS. 1 and 2, an electrical connector 10 constructed in accordance with the present invention comprises an insulative housing 12 defining a plurality of spaced channels 14 therein for receiving and retaining conductive spring contacts 16.

Each contact 16 is U-shaped and comprises an anchoring section 18 and a resilient engaging section 20 which is resiliently attached to the anchoring section 18 by a U-shaped bent section 22. An opening 24 is defined in the bent section 22 through which a wire 26 extends. A soldering section 28 is formed on a free end of the anchoring section 18, serving as an extension thereof. Barbs 30 are formed on opposite edges of the anchoring section 18.

The engaging section 20 of each contact 16 has a convex central portion (not labeled) on which a raised portion 32 is formed. Transversely extending side projections 34 are formed on a free end of the engaging section 20.

Each channel 14 of the housing 12 is defined by a bottom panel 40, an end wall 38 and two spaced side walls 36 extending therefrom. The anchoring section 18 of the corresponding contact 16 is positioned on the bottom panel 40. A slit 42 is defined in each side wall 36 for interferentially receiving the barbs 30 of the corresponding anchoring section 18 thereby fixing the contact 16 in the channel 14. Recesses 44 are defined in the side walls 36 and form stops 46 to engage with and retain the side projections 34 of the engaging section 20 of the corresponding contact 16. The contact 16 is dimensioned so that the resilient engaging section 20 is preloaded when the side projections 34 engage with and are retained by the stops 46. The convex central portion of the engaging section 20 partially extends beyond a top surface of the housing 12 for electrically engaging with an electronic device.

Figure 3:
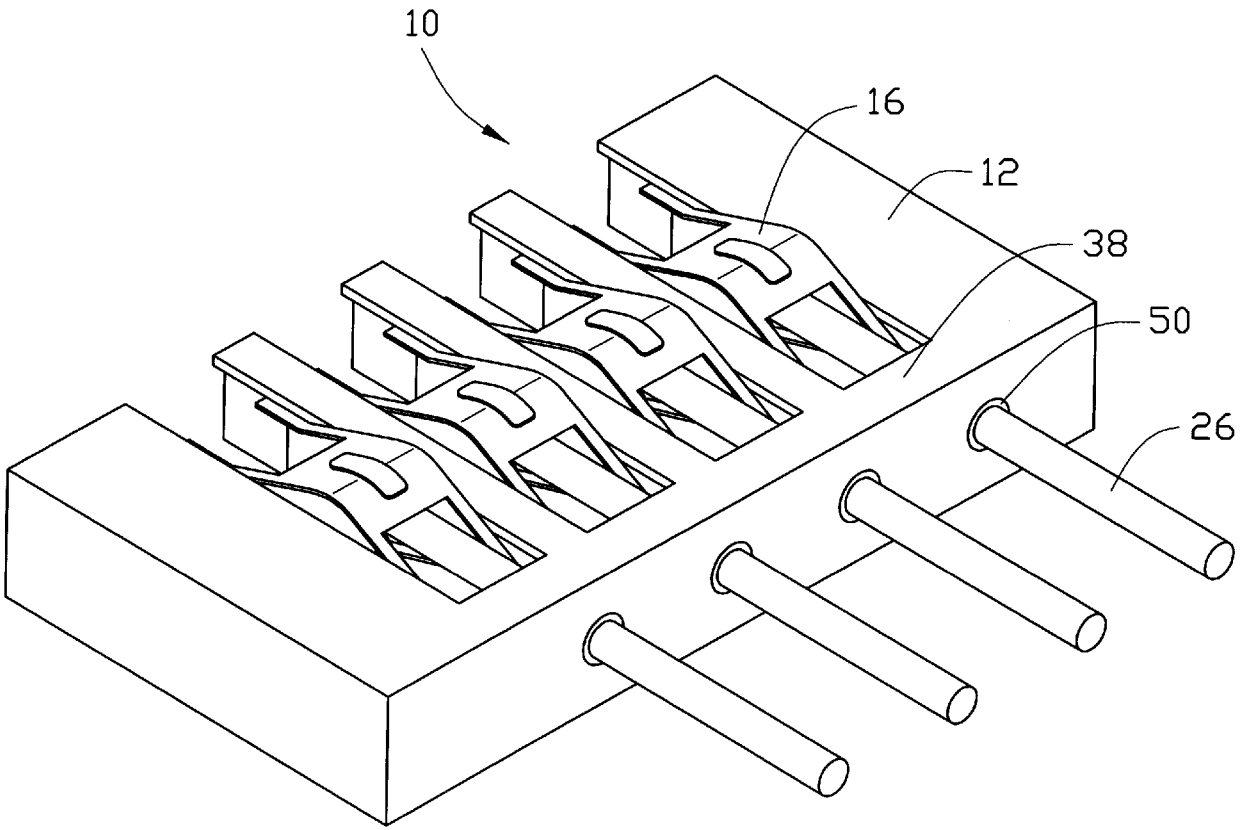
FIG. 3 is another perspective view of the electrical connector of the resent invention.

The wire 26 extending through the opening 24 of the bent section 22 of each contact 16 has a stripped leading end, and a conductive core 48 thereof is exposed and soldered to the soldering section 28 of the contact 16. As shown in FIG. 3, a plurality of holes 50 is defined in the end wall 38 of the housing 12 through which the wires 26 extend. The bent section 22 of each contact 16 may be arranged to abut against the end wall 38 for resisting a pulling force exerted on the wire 26.

By means of the overlapping arrangement of the soldering section 28 and the resilient engaging section 20, the space occupied by the contact 16 is reduced compared to the conventional design. Furthermore, the preloading of the engaging section 20 ensures proper engagement between the raised portion 32 of the contact 16 and the electronic device.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising an insulative housing defining a plurality of channels for receiving and retaining conductive spring contacts therein, each contact being U-shaped and comprising an anchoring section fixed in the corresponding channel and an engaging section resiliently attached to the anchoring section by a U-shaped bent section and adapted to engage with an electronic device, an opening being defined in the bent section through which a wire extends with a conductive core of the wire being fixed to the anchoring section.

2. The electrical connector as claimed in claim 1, wherein the anchoring section comprises a soldering section to which the conductive core of the wire is soldered.

3. The electrical connector as claimed in claim 1, wherein each channel is defined by two side walls, each side wall defining a slit for interferentially receiving a barb formed on opposite edges of the anchoring section of each contact thereby fixing the contact in the channel.

4. The electrical connector as claimed in claim 1, wherein the engaging section of each contact comprises a convex portion extending beyond the housing for electrically engaging with the electronic device.

5. The electrical connector as claimed in claim 4, wherein a raised portion is formed on the convex portion for engaging with the electronic device.

6. The electrical connector as claimed in claim 1, wherein the engaging section has a free end having opposite side projections engaging with recesses defined in side walls of the channel for preloading the engaging section.

7. The electrical connector as claimed in claim 1, wherein an end wall of the housing defines a plurality of holes therethrough, each hole communicating with the corresponding channel, the wire extending through the corresponding hole.

8. An electrical connector assembly comprising:

an insulative housing defining a plurality of channels for receiving conductive spring contacts therein, each of said contacts including a first section at a lower level and a second section at an upper level, the first and second sections being in generally alignment with each other in a vertical direction; and a plurality of wires extending from a lateral side of the housing, along a lengthwise direction of the contacts, into the corresponding channels, respectively, each of said wires including a conductive core electrically and mechanically connected to said second section of the corresponding contact, of which the second section extends upward out of a top surface of the housing for engagement with an electronic device, wherein an opening is defined in the second section of each of the contacts, an end portion of each of said wires extending through a corresponding opening and being fixed to the first section of a corresponding contact.

9. The connector assembly as claimed in claim 8, wherein an end portion of each of said wires is generally positioned between said first section and said second section.

10. A wire harness connector assembly including an insulative housing with a plurality of wires extending thereinto, said housing defining a plurality of channels, a plurality of contacts received within the corresponding channels, respectively, each of said contacts comprising a lower planar anchoring section securely fixed to the housing and connected, via a bent section, to an upper convex engagement section extending beyond a top surface of the housing, said bent section defining an opening through which a corresponding wire extends from an exterior and into a space between said anchoring section and said engagement section.

* * * * *